US007799239B2

(12) United States Patent
Shigeno et al.

(10) Patent No.: US 7,799,239 B2
(45) Date of Patent: Sep. 21, 2010

(54) PHOSPHATE ESTER TREATED PARA-TYPE AROMATIC POLYAMIDE SHORT FIBERS

(75) Inventors: Haruo Shigeno, Ehime (JP); Shouji Makino, Ehime (JP); Tomohiro Okuya, Osaka (JP)

(73) Assignee: Teijin Techno Products Limited, Osaka (JP)

( * ) Notice: Subject to any disclaimer, the term of this patent is extended or adjusted under 35 U.S.C. 154(b) by 287 days.

(21) Appl. No.: 11/666,748

(22) PCT Filed: Oct. 27, 2005

(86) PCT No.: PCT/JP2005/020146

§ 371 (c)(1),
(2), (4) Date: May 1, 2007

(87) PCT Pub. No.: WO2006/049188

PCT Pub. Date: May 11, 2006

(65) Prior Publication Data

US 2008/0045691 A1 Feb. 21, 2008

(30) Foreign Application Priority Data

Nov. 1, 2004 (JP) ..... 2004-317836
Nov. 2, 2004 (JP) ..... 2004-319095

(51) Int. Cl.
*D06M 13/292* (2006.01)
*D06M 13/402* (2006.01)
*D06M 13/419* (2006.01)
*D06M 101/36* (2006.01)
*C08G 69/32* (2006.01)

(52) U.S. Cl. ..... 252/8.84; 428/359; 428/361; 428/378; 428/395; 252/8.82; 528/348; 558/70

(58) Field of Classification Search ..... 428/361, 428/378, 395; 252/8.84; 558/70
See application file for complete search history.

(56) References Cited

U.S. PATENT DOCUMENTS 3,341,451 A * 9/1967 Dziuba et al. ..... 252/8.81
4,670,575 A * 6/1987 Kurosaki et al. ..... 558/146
4,900,455 A * 2/1990 Kolbe et al. ..... 252/8.84
5,154,969 A 10/1992 Kerawalla
5,478,648 A 12/1995 Stein et al.
5,491,026 A * 2/1996 Mudge et al. ..... 428/395
6,262,130 B1 * 7/2001 Derian et al. ..... 516/56

FOREIGN PATENT DOCUMENTS

| | | | |
|---|---|---|---|
| EP | 423703 | A2 * | 4/1991 |
| GB | 1 325 075 | | 8/1973 |
| JP | 50-195 | A | 1/1975 |
| JP | 58-65070 | A | 4/1983 |
| JP | 3-185180 | | 8/1991 |
| JP | 6-108361 | | 4/1994 |
| JP | 9-188969 | | 7/1997 |
| JP | 10-183469 | | 7/1998 |
| JP | 10-212664 | A | 8/1998 |
| JP | 2001-207379 | | 8/2001 |
| JP | 2001207379 | A * | 8/2001 |
| JP | 2002-227076 | A | 8/2002 |

OTHER PUBLICATIONS

Rouette, Hans-Karl, Encyclopedia of Textile Finishing. 2001 Woodhead Publishing.*
Clements, Linda L, Organic Fibers, Handbook of Composites, 2nd Ed. Peters, S.T., 1998, Springer-Verlag.*
Honngu, Tatsuya et al, "New Fibers (2nd Edition)," 1997, Woodhead Publishing, pp. 18-20.*
Processing Finish for Amorphous Aramid Staple; Research Disclosure, Mason Publications, Hampshire, GB, Jul. 1, 1982, p. 239.

* cited by examiner

*Primary Examiner*—Randy Gulakowski
*Assistant Examiner*—Rachel Kahn
(74) *Attorney, Agent, or Firm*—Sughrue Mion, PLLC

(57) ABSTRACT

Para-type aromatic polyamide short fibers are attached with a phosphate ester alkali metal salt of an alcohol having a carbon number of 12 having a molar fraction of a monoester salt of from 45 to 70% by mol and a molar fraction of a diester salt of from 10 to 40% by mol in an amount of from 0.05 to 1.0% by weight based on the weight of the fibers, whereby such para-type aromatic polyamide short fibers excellent in spinning property are obtained that are excellent in bundling property and antistatic property, and are low in adhesion property causing less twining on rollers and less formation of scums.

3 Claims, No Drawings

PHOSPHATE ESTER TREATED PARA-TYPE AROMATIC POLYAMIDE SHORT FIBERS

TECHNICAL FIELD

The present invention relates to para-type aromatic polyamide short fibers excellent in spinning property. More specifically, the invention relates to such para-type aromatic polyamide short fibers that are excellent in bundling property and antistatic property in a spinning process, cause less twining on rollers and less formation of scums in a spinning process, and are excellent in lubricating property under extreme pressure friction, thereby being capable of stably producing high-quality spun threads of 100% aramid and high-quality blended threads with other fibers.

BACKGROUND ART

Para-type aromatic polyamide fibers formed of a para-oriented aromatic dicarboxylic acid component and an aromatic diamine component have been widely used for industrial material purposes and functional clothing purposes by taking advantages of such characteristics as high strength, high modulus of elasticity and high heat resistance. In particular, the demand of para-type aromatic polyamide short fibers is being increased in recent years mainly for functional clothing purposes required to have high strength and high heat resistance, such as fireman clothing, protective clothing and safety gloves.

However, para-type aromatic polyamide fibers have high rigidity and are difficult to be imparted with sufficient winding crimping property even though indentation crimping is applied thereto, and thus they become insufficient in bundling property in a spinning process as being combined with the high modulus of elasticity, whereby such a problem arises that handling failure and web breakage are liable to occur due to the bulkiness thereof.

Furthermore, various problems in a spinning process are being elicited that are ascribable to the characteristics inherent to para-type aromatic polyamide, such as formation of scums through fibrillation and generation of static charge due to high orientation and high strength of the fibers.

In view of the problems, an oily agent that has been used for other fibers, such as polyester long fibers and short fibers and polyamide fibers for industrial material purposes, is often applied to the conventional para-type aromatic polyamide fibers, but associated with elicitation of the problems, there arises an increasing demand of a unique oily agent that is dedicated to the characteristics of the para-type aromatic polyamide, and development thereof is being attempted.

For example, JP-A-3-185180 proposes a method of improving antifriction property on the fiber surface (suppressing scums) by applying an ethoxylated alkyl phosphate ester, and JP-A-9-188969 proposes a method of preventing fibers from being dropped in a spinning process by applying an oily agent containing a long-chain alkyl phosphate ester having a particular carbon number, so as to suppress wholly aromatic polyamide fibers from being fibrillated.

However, the ethoxylated alkyl phosphate ester is excellent in antistatic property and antifriction property, but has such a problem that the adhesion property thereof is changed with lapse of time due to the hygroscopic property thereof, which brings about twining on various rollers in a spinning process. The long-chain alkyl phosphate ester having a carbon number of from 18 to 20 is effective for decreasing spinning scums and twining on rollers, but has a problem of insufficient spinning property due to insufficient bundling property of the fibers.

In order to solve the problems, JP-2001-207379 proposes a method of applying an oily agent containing an alkyl phosphate ester having a carbon number of from 14 to 16 and an antistatic agent. According to the method, the bundling property and the antistatic property are improved, and twining on rollers is also reduced, to improve the spinning property, but the antistatic property at a low temperature and a low humidity is still insufficient, which brings about necessity of combination use of another antistatic agent, and thus further improvement is being demanded.

In recent years, a considerably high speed operation is being practiced not only in curding, drawing and roving but also in fine spinning for the purpose of reducing the spinning cost by high productivity, energy saving and high efficiency. In the high-speed spinning, the amount of scums is increased since the amount of fibers passing through a spinning machine is increased in proportion to the speed, whereby such problems arise that not only the frequency of cleaning is increased to deteriorate the operability, but also breakage of thread is caused thereby. In order to solve the problems, JP-A-6-108361 proposes a method of applying an oily agent containing an alkyl phosphate ester potassium salt, paraffin wax and a cationic surfactant, and JP-A-10-183469 proposes a method of applying an oily agent containing at least one compound selected from the group consisting of a compound obtained by blocking at least a part of terminal hydroxyl groups of an ethylene oxide adduct of alkylamine with an alkyl group, an alkenyl group or an acyl group, a neutralized product of the compound with phosphoric acid or a phosphate ester, and a quaternarized product of the compound, and the oily agent also containing a lubricating material. However, these attempts are still insufficient for aromatic polyamide fibers, and further improvement is being demanded.

DISCLOSURE OF THE INVENTION

An object of the invention is to solve the problems associated with the conventional art and to provide such para-type aromatic polyamide short fibers that are excellent in bundling property and antistatic property in a spinning process, cause less twining on rollers and less formation of scums in a spinning process, and are excellent in lubricating property under extreme pressure friction.

As a result of investigations for solving the problems made by the inventors, the invention has been completed.

The object of the invention is attained by para-type aromatic polyamide short fibers characterized by being attached with a phosphate ester alkali metal salt of an alcohol having a carbon number of 12 satisfying the following A and B simultaneously in an amount of from 0.05 to 1.0% by weight based on the weight of the fibers:

A: a molar fraction of a monoester salt of from 45 to 70% by mol, and

B: a molar fraction of a diester salt of from 10 to 40% by mol.

BEST MODE FOR CARRYING OUT THE INVENTION

Embodiments of the invention will be described in detail below.

The para-type aromatic polyamide short fibers of the invention are short fibers formed of a para-type wholly aromatic polyamide constituted by a para-oriented aromatic dicarboxylic component and an aromatic diamine component or an aromatic aminocarboxylic acid component, or a para-type aromatic copolymer polyamide thereof, in which the aromatic group may be two aromatic rings connected through oxygen, sulfur, an alkylene group or a direct bond, and the aromatic group may be substituted with a lower alkyl group, such as a methyl group and an ethyl group, a methoxy group, a halogen group, such as a chlorine group.

Specific examples of the para-type aromatic polyamide short fibers include poly-p-phenylene terephthalamide short fibers and copoly-p-phenylene 3,4'-oxydiphenylene terephthalamide short fibers.

It is important in the invention that a phosphate ester alkali metal salt of an alcohol having a carbon number of 12 is attached to the surface of the para-type aromatic polyamide short fibers in an amount of from 0.05 to 1.0% by weight, preferably from 0.1 to 0.5% by weight, and more preferably from 0.15 to 0.4% by weight, based on the weight of the fibers. In the case where the attached amount of the phosphate ester alkali metal salt is less than 0.05% by weight, it is not preferred since the antistatic property and the bundling property are insufficient to fail to spin stably. In the case where the attached amount exceeds 1.0% by weight, on the other hand, it is not preferred since scums and twining on rollers frequently occur in a spinning process due to too large adhesion property.

The carbon number of the alcohol of the phosphate ester alkali metal salt is important and is necessarily 12. In general, a monoester and a diester are present in a phosphate ester alkali metal salt, and in the case where the content ratio thereof is specified when the carbon number of the alcohol is 12, excellent bundling property and antistatic property are attained while preventing occurrence of scums and twining on rollers from being increased, whereby high-quality spun threads can be obtained. That is, it is necessary that the molar fraction of a monoester is from 45 to 70% by mol, and preferably from 50 to 60% by mol, and the molar fraction of a diester is from 10 to 40% by mol, and preferably from 15 to 30% by mol. In the case where the molar fraction of a monoester is less than 45% by mol, it is not preferred since the antistatic property is deteriorated, and in the case where the molar fraction of a monoester exceeds 70% by mol, on the other hand, it is not preferred since twining in a spinning process frequently occurs. In the case where the molar fraction of a diester is less than 10% by mol, it is not preferred since twining in a spinning process frequently occurs, and in the case where the molar fraction of a diester exceeds 40% by mol, on the other hand, it is not preferred since the antistatic property is deteriorated. The phosphate ester alkali metal salt of the invention may contain a phosphate alkali metal salt without alcohol added, an alkali metal salt of polyphosphoric acid, a polyphosphate ester alkali metal salt and the like (which are totally referred to as others in some cases).

Examples of the alkali metal of the phosphate ester alkali metal salt include sodium, potassium and lithium, and potassium is preferred among these.

A phosphate ester alkali metal salt is generally produced by reacting phosphorus pentoxide and a prescribed amount of an alcohol to synthesize a partial phosphate ester, and then neutralizing the excess acid with an alkali metal hydroxide, and the phosphate ester alkali metal salt used in the invention can be conveniently produced by controlling the using amount of the alcohol and the reaction temperature appropriately.

It is preferred that the para-type aromatic polyamide fibers of the invention are attached with, in addition to the phosphate ester alkali metal salt, a fatty acid alkanolamide and/or a polyoxyethylene fatty acid amide in an amount of from 0.01 to 0.2% by weight, preferably from 0.03 to 0.15% by weight, and particularly preferably from 0.03 to 0.10% by weight, based on the weight of the fibers. The fatty acid alkanolamide referred herein intends a condensed product of an alkanolamine, such as monoethanolamine, diethanolamine and isopropanolamine, with a fatty acid, and the polyoxyethylene fatty acid amide referred herein intends an addition polymer obtained by adding ethylene oxide to a fatty acid amide, or a dehydration condensed product of a fatty acid amide with polyethylene glycol. In other words, it is a nonionic surfactant obtained by addition-polymerizing ethylene oxide, or dehydration-condensing polyethylene glycol, to two active hydrogen atoms bonded to the nitrogen atom of the fatty acid amide.

In the case where the aliphatic acid alkanolamide and/or the polyoxyethylene fatty acid amide are attached in addition to the phosphate ester salt, excellent lubricating property can be obtained under extreme pressure friction to enable stable spinning in a high-speed spinning process, and not only accumulation of scums on respective guides and rollers in the respective steps is decreased, but also damages received from guides and rollers are considerably decreased, whereby thread breakage is considerably suppressed, and the quality of the resulting spun threads is also considerably improved.

In the invention, other fiber treating agent components, such as a lubricating agent (for example, a mineral oil, such as liquid paraffin, a monovalent fatty acid ester, such as lauryl oleate and isotridecyl stearate, a dibasic acid diester, such as dioleyl adipate and dioctyl sebacate, a polyvalent alcohol ester, such as trimethylolpropane trilaurate and palm oil, and propylene oxide-ethylene oxide copolymer polyether), a releasing agent, an antiseptic and a defoaming agent, may be appropriately added depending on necessity in such a range that does not impair the object of the invention, in general 20% by weight or less of the aforementioned components.

The para-type aromatic polyamide short fibers of the invention are not particularly limited in monofilament fineness, fiber length, crimp number, crimp ratio and the like, and those having a monofilament fineness in a range of from 0.8 to 5.0 dtex, a fiber length in a range of from 38 to 76 mm, a crimp number in a range of from 6 to 15 per 25 mm, and a crimp ratio in a range of from 7.5 to 19% are particularly suitable.

The method for attaching the phosphate ester alkali metal salt to the fiber surface is not particularly limited, and ah arbitrary method may be employed, such as a known method, e.g., a method of spraying an aqueous solution or an aqueous dispersion liquid of the composition (hereinafter, abbreviated simply to a treating agent in some cases) onto the fibers, a method of immersing the fibers in a bath, and a method of making the fibers in contact with a oil feeding roller or guide.

EXAMPLE

The constitution and advantages of the invention will be described with reference to examples below. The properties in the examples were obtained in the following manners.

(1) Bundling Property

The para-type aromatic polyamide short fibers attached with the treating agent were measured for wrapped bulk ($cm^3/g$) in a scutching process. It was determined good when the wrapped bulk was 21 $cm^3/g$ or less.

(2) Antistatic Property

An electrostatic potential was measured above 10 cm from the web in a curding process conditioned in humidity to 20° C. and 65% RH. It was determined good when the absolute value thereof was 0.5 kV or less.

(3) Spinning Scums 100 kg of the para-type aromatic polyamide short fibers were subjected to a drawing process conditioned in humidity to 20° C. and 65% RH, and the total amount of scums attached to rubber rollers, metallic rollers and guides was measured. It was determined good when the weight thereof was 15 mg/100 kg or less.

(4) Twining on Rollers 100 kg of the para-type aromatic polyamide short fibers were subjected to a drawing process conditioned in humidity to 20° C. and 65% RH, and the number of twining on rollers was measured. It was determined good when the number was 2/100 kg or less.

(5) Damage of Fibers in High-Speed Spinning

A fine spinning process was carried out under the following conditions, and 50 thread fragments of 5 cm in length randomly cut from the thread under a lower part of a cup (with which the thread and an antinode ring were in contact) were counted for number of existing fibrils through observation with an optical microscope. It was determined good when the number was less than 5.

Spindle rotation number: 20,000 rpm
Ring diameter: 38 mm
Lift: 6 inch
Total draft: 40 times
Thread size: No. 40

Examples 1 to 5

Drawn threads of a para-type aromatic copolymer polyamide formed of 25% by mol of a p-phenylenediamine component, 25% by mol of a 3,4'-diaminodiphenyl ether component and 50% by mol of a terephthalic acid component, having 1,670 dtex/1,000 fil were attached with a treating agent having the formulation shown in Table 1 (the phosphate ester salt in the treating agent was lauryl phosphate potassium salt, and specific examples of the other phosphate ester salt therein were a phosphoric acid alkali metal salt without alcohol added, an alkali metal salt of polyphosphoric acid, and a phosphate ester alkali metal salt having three or more alcohols added) by an immersing method to an attached amount shown in Table 1, and then the threads were subjected to indentation crimping at a preheating temperature of 95° C. and dried at 105° C., followed by cutting into a length of 51 mm, to obtain 100 kg of each of para-type aromatic polyamide short fibers having a crimp number of 11.0 per 25 mm and a crimp ratio of 13.5%. The short fibers were subjected to single scutcher to form wraps and fed to a curding machine to for curd slivers, which was then subjected to a drawing machine. The aforementioned evaluations were carried out during the processes. The results obtained are shown in Table 1. It is understood from the table that the para-type aromatic polyamide short fibers of the invention have good spinning property.

Comparative Examples 1 to 3

100 kg of each of para-type aromatic polyamide short fibers of the levels were obtained in the same manner as in Example 1 except that the formulation of the treating agent and the attached amount thereof in Example 1 were changed to those shown in Table 1.

The resulting short fibers were evaluated in the same manner as in Example 1. The results obtained are shown in Table 1.

It is understood from the table that in the case where the molar fraction of a monoester is too large (Comparative Example 1), not only the amount of spinning scums is increased, but also the number of twining on rollers is increased. In the case where the attached amount of the treating agent is too large (Comparative Examples 2 and 3), not only the amount of spinning scums is increased, but also the number of twining on rollers is increased. It is understood that all the cases lead to deterioration in spinning property.

TABLE 1

| | | | | Example 1 | Example 2 | Example 3 | Example 4 | Example 5 |
|---|---|---|---|---|---|---|---|---|
| Treating agent | Phosphate ester salt | Monoester | % by mol | 50 | 50 | 60 | 60 | 50 |
| | | Diester | % by mol | 30 | 30 | 30 | 30 | 30 |
| | | Others | % by mol | 20 | 20 | 10 | 10 | 20 |
| | | Attached amount | % by weight | 0.2 | 0.4 | 0.2 | 0.4 | 0.4 |
| | Attached amount of lauric acid diethanolamide | | % by weight | 0 | 0 | 0 | 0 | 0.05 |
| Spinning property | Bundling property (wrapped bulk) | | $cm^3/g$ | 19.3 | 18.5 | 19.6 | 18.3 | 18.5 |
| | Antistatic property | | kV | 0 | 0 | 0 | 0 | 0 |
| | Spinning scums | | mg/100 kg | 3.0 | 7.4 | 3.3 | 8.1 | 7.2 |
| | Twining on rollers | | number per 100 kg | 0 | 0 | 0 | 1 | 0 |
| | Damage of fibers | | number | 3 | 2 | 2 | 1 | 0 |

| | | | | Comparative Example 1 | Comparative Example 2 | Comparative Example 3 |
|---|---|---|---|---|---|---|
| Treating agent | Phosphate ester salt | Monoester | % by mol | 80 | 50 | 60 |
| | | Diester | % by mol | 20 | 30 | 30 |
| | | Others | % by mol | 0 | 20 | 10 |
| | | Attached amount | % by weight | 0.4 | 1.2 | 1.2 |
| | Attached amount of lauric acid diethanolamide | | % by weight | 0 | 0 | 0 |
| Spinning property | Bundling property (wrapped bulk) | | $cm^3/g$ | 20.0 | 17.3 | 17.4 |
| | Antistatic property | | kV | 0 | 0 | 0 |
| | Spinning scums | | mg/100 kg | 17.8 | 23.2 | 18.6 |
| | Twining on rollers | | number per 100 kg | 3 | 5 | 4 |
| | Damage of fibers | | number | 7 | 6 | 7 |

INDUSTRIAL APPLICABILITY

The para-type aromatic polyamide short fibers of the invention are excellent in adhesion property and antifriction property and also excellent in bundling property and antistatic property, and can be suppressed in various problems in a spinning process and the like to provide high-quality spun threads extremely stably. Accordingly, the fibers can be favorably used for various industrial purposes, such as protective clothing, owing to the characteristics.

The invention claimed is:

1. Para-type aromatic polyamide short fibers having a length of from 38 to 76 mm coated with a phosphate ester alkali metal salt of an alcohol having 12 carbon atoms satisfying the following A and B simultaneously: wherein said phosphate ester alkali metal salts are coated in an amount of from 0.05 to 1.0% by weight based on the weight of the fibers:

A: a molar fraction of a monoester salt of from 45 to 70% by mol, and

B: a molar fraction of a diester salt of from 10 to 40% by mol.

2. The para-type aromatic polyamide short fibers according to claim 1, wherein in addition to the phosphate ester alkali metal salt, a fatty acid alkanolamide and/or a polyoxyethylene fatty acid amide is coated in an amount of from 0.01 to 0.20% by weight based on the weight of the fibers.

3. The para-type aromatic polyamide short fibers according to claim 1, wherein the para-type aromatic polyamide is copoly-p-phenylene 3,4'-oxydiphenylene terephthalamide.

* * * * *